US007745710B2

(12) United States Patent
Campling

(10) Patent No.: US 7,745,710 B2
(45) Date of Patent: Jun. 29, 2010

(54) SPRING CAPO

(75) Inventor: Nicholas John Campling, Peterborough (GB)

(73) Assignee: C7th Limited, Peterborough (GB)

( * ) Notice: Subject to any disclaimer, the term of this patent is extended or adjusted under 35 U.S.C. 154(b) by 0 days.

(21) Appl. No.: 12/015,777

(22) Filed: Jan. 17, 2008

(65) Prior Publication Data

US 2008/0168882 A1 Jul. 17, 2008

(30) Foreign Application Priority Data

Jan. 17, 2007 (GB) ..... 0700849.3
Jun. 28, 2007 (GB) ..... 0712542.0

(51) Int. Cl.
*G10D 3/00* (2006.01)

(52) U.S. Cl. ..... 84/318; 84/312 R

(58) Field of Classification Search ..... 84/312 R, 84/318, 290

See application file for complete search history.

(56) References Cited

U.S. PATENT DOCUMENTS

| | | | | |
|---|---|---|---|---|
| 390,612 | A | 10/1888 | Moffat | |
| 432,165 | A | 7/1890 | McKeever | |
| 4,143,576 | A | 3/1979 | Nichols et al. | |
| 4,149,443 | A | 4/1979 | Bringe | |
| 4,250,790 | A | 2/1981 | Shubb et al. | |
| 4,270,432 | A | 6/1981 | Wilkerson | |
| 4,324,165 | A | 4/1982 | Wilkerson | |
| 4,583,440 | A | 4/1986 | Powell, Jr. | |
| 5,431,080 | A | 7/1995 | Wiesenthal | |
| 5,492,045 | A | 2/1996 | Roblee | |
| D372,259 | S | 7/1996 | Kyser | |
| D378,825 | S | 4/1997 | Dunlop | |
| 5,623,110 | A * | 4/1997 | Hoglund et al. | 84/318 |
| 5,792,969 | A | 8/1998 | Shubb et al. | |
| 6,008,441 | A * | 12/1999 | Steinberger | 84/318 |
| 6,459,025 | B1 | 10/2002 | D'Addario | |
| 6,528,711 | B1 * | 3/2003 | Paige | 84/318 |
| 6,635,813 | B2 | 10/2003 | Campling | |
| 6,965,067 | B2 | 11/2005 | Kondo | |
| 2004/0261600 | A1 | 12/2004 | Silva | |
| 2005/0098019 | A1 | 5/2005 | Tran | |

OTHER PUBLICATIONS

"Capos attached from the side with spring", http://web.telia.com/~u86505074/capomuseunn/Side/Spring/side_spr.htm, Nov. 30, 2006, pp. 1-6 .

(Continued)

*Primary Examiner*—Kimberly R Lockett
(74) *Attorney, Agent, or Firm*—Brooks Kushman P.C.

(57) ABSTRACT

A capo for use with a stringed instrument having a plurality of strings a neck comprising a fingerboard and a back comprises a string-engaging arm, a clamping arm, and a pivotal connection to pivotally interconnect a string-engaging arm and clamping arm. The string-engaging arm adapted to in use extend across the fingerboard above the strings and in use press against the strings. The clamping arm is adapted to, in use, extend across engage the back of the neck. The pivotal connection is disposed, in generally towards one side of the neck and at a position behind the fingerboard inboard of a side edge of the fingerboard. This arrangement and location of the pivotal connection reduces the forces required in use to operate the capo.

20 Claims, 2 Drawing Sheets

OTHER PUBLICATIONS

Capos Attached From the Side With Lever—http://web.telia.com/~u86505074/capomuesum/Side/Lever/side_lev.htm 4 Pages.

Capos Attached From the Side With Screw—http://web.telia.com/~u86505074/capomuesum/Side/Screw/side_scr.htm 9 Pages.

Capos Attached From the Side With Spring—http://w1.865.telia.com/~u86505074/capomuseum/Side/Spring/side_spr.htm 7 Pages.

Capos With Yoke and Spring—http://web.telia.com/~u86505074/capomeseum/Yoke/Spring/yoke_spr.htm 2 Pages.

The Sterner Capo Museum—http://w1.865.telia.com/~86505074/capomuseum/index.htm 3 Pages.

Sterner Stuff—htt://www.sternercapo.se/ 1 Page.

* cited by examiner

SPRING CAPO

CROSS-REFERENCE TO RELATED APPLICATIONS

This application claims foreign priority benefits under 35 U.S.C. §119(a)-(d) to GB 0700849.3, filed Jan. 17, 2007 and GB 0712542.0, filed Jun. 28, 2007, which are hereby incorporated by reference in their entirety.

BACKGROUND OF THE INVENTION

1. Field of the Invention

The present invention relates to a capo for a stringed instrument, in particular a guitar, banjo or similar such instrument.

2. Background Art

A capo, sometimes variously termed a capodastro, capodaster, capo tasto or cejilla, is a device well-known and used by players of stringed instruments and in particular guitar and banjo players. A capo can be used with a stringed instrument, for example a guitar or banjo, which has a neck and a set of strings extending along the length of the neck. The neck comprises a fingerboard portion adjacent to the strings and a back. The fingerboard includes a number of fret bars which protrude slightly from the fingerboard/neck surface and extend laterally across the neck. The capo, when applied, serves to hold the strings against the fingerboard provided along the neck, and in particular against one of the number of fret bars disposed along the length of the fingerboard and which extend from the fingerboard, to reduce the effective length of the strings and therefore adjust the pitch produced by the strings.

When a capo is in use on an instrument neck a string-engaging portion or arm of the capo is arranged to press the strings against the surface of the fingerboard to sandwich the strings against the fret bars and/or fingerboard. In order to press the string-engaging portion against the fingerboard the capo is required, and includes suitable means for it, to be clamped to the neck. In a number of previous capo designs the clamping of the capo to the neck has been provided through the use of relatively cumbersome clamping mechanisms utilizing screw mechanisms, toggle levers, springs and other means which are difficult to handle and/or time consuming to attach. In particular, the constructions of previous capos have generally been such that the acts of attaching one to an instrument neck, removing it, or moving its position have undesirably required the use of two hands.

There are numerous examples of such capo designs including such clamping mechanisms. In particular examples of such designs are proposed and described in the following patents: U.S. Pat. No. 5,492,045; U.S. Pat. No. 4,149,443; U.S. Pat. No. 6,965,067, US 2004/0261600, U.S. Pat. No. 390,612 and U.S. Pat. No. 5,792,969.

In other prior capo designs spring activated mechanisms (generally torsion springs) are used to provide the clamping force. Examples of such capos are described in U.S. Pat. No. 4,143,576, U.S. Pat. No. 6,528,711, U.S. Pat. No. 4,583,440, U.S. Pat. No. 5,623,110, US 2005/0098019 and U.S. Des Pat. 378,825 and U.S. Des Pat. 372,259. With the spring type capo designs the string-engaging arm is pivotally attached at one end to a clamping arm. In use the capo is fitted to the instrument neck with the string-engaging arm abutting against the strings and pressing the strings toward the fingerboard whilst the clamping arm abuts and bears against the opposite rear surface of the neck. A torsion spring is provided within/adjacent to the pivotal mounting to urge the two arms together, with the strings and neck of the instrument sandwiched therebetween, and provide the clamping force.

As described in the prior patents such spring type capo designs are easier and quicker to apply and can be fitted by the player one handed. However, the force generally required to be applied by the user to apply, adjust or remove such spring activated capos is high and uncomfortablef or the user.

A further prior capo design described in U.S. Pat. No. 6,008,441 has sought to alleviate this problem by use of a toggle type linkage. This linkage, however, adds to the bulk and cost of the device.

SUMMARY OF THE INVENTION

It is therefore desirable to provide an improved capo, and in particular a spring type activated capo which addresses the above described problems by providing a capo which is simple and easy to apply with one hand and without the user having to use excessive force. More generally it is desirable to provide a capo which offers improvements or an alternative to existing capo designs.

According to the present invention there is therefore provided a capo as described in the accompanying claims.

BRIEF DESCRIPTION OF THE DRAWINGS

The present invention will now be described by way of example only with reference to the following figures in which.

DESCRIPTION OF THE PREFERRED EMBODIMENT(S)

In an embodiment of one aspect of the invention there is provided a capo for use with a stringed instrument having a plurality of strings and a neck. The neck comprises a fingerboard and a back. The capo comprises a string-engaging arm, a clamping arm and a pivotal connection to pivotally interconnect the two arms. The string-engaging arm is adapted to extend across the fingerboard above the strings and in use press against the strings. The clamping arm is adapted, in use, to extend across and engage the back of the neck. The pivotal connection pivotally interconnects the clamping arm to the string-engaging arm at a position along said arms that is arranged, in use, to be adjacent said neck such that the arms can be pivoted relative to each other in order to, in use, fit and clamp the strings and neck between said arms. A spring is provided to urge the arms towards the neck. Lever arms are provided attached to each arm such that urging the lever arms together will open the clamping arms and release the capo from the neck.

Preferably the pivotal connection is disposed, in use, generally towards one side of the neck. The axis of the pivotal connection is also positioned behind the fingerboard, and in particular such that it is substantially closer to the point of contact between the neck and the clamping arm than in previously disclosed spring capo designs where the axis is positioned to the side of the fingerboard. In other words, and when viewed in cross section, the pivot axis is positioned inboard of the edge of the fingerboard. This allows for a smaller force to be used at a given distance from the pivotal connection to overcome the clamping force than in previous designs.

To achieve this the capo includes an extension, which extends around and behind the neck of the instrument to locate the pivot axis and support the clamping arm. It will be appreciated however that other arrangements may be used to locate the pivot axis suitably behind the fingerboard and inboard of an edge of the fingerboard.

Figure 1:
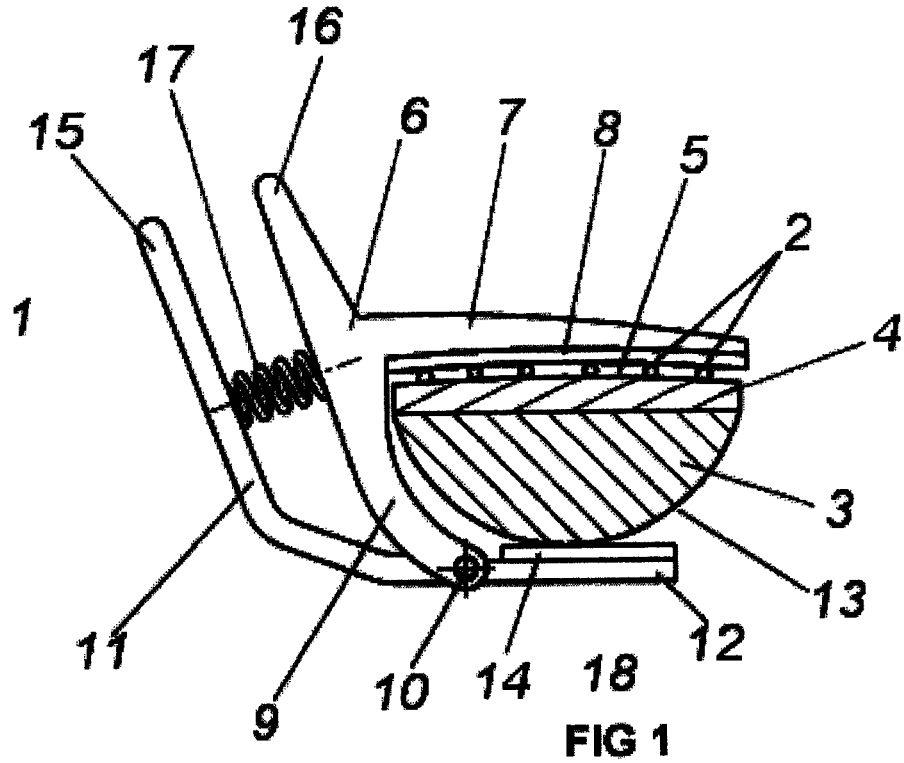
FIG. 1 is a cross section through the neck of a stringed instrument and side elevation of a capo according to an embodiment of the present invention installed on the neck.
Figure 2:
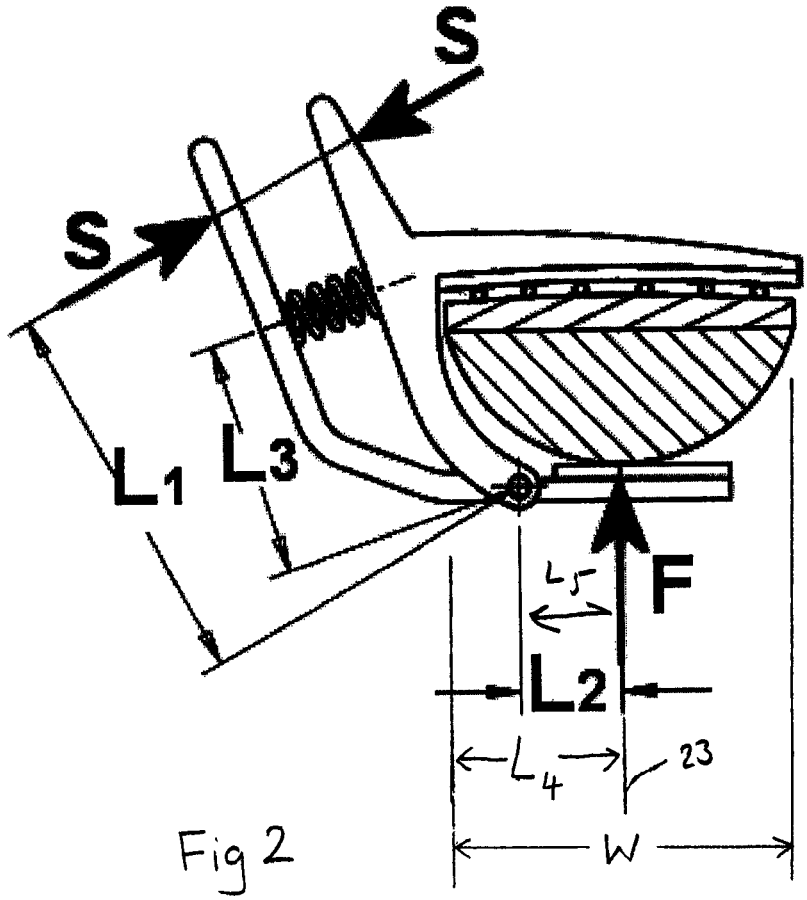
FIG. 2 shows the forces applied and distances of the forces from the pivot axis on the capo shown in FIG. 1.

A capo 1 according to a preferred embodiment of the present invention is shown in FIGS. 1 and 2. Referring to FIG. 1 the capo 1 is arranged to be applied to a stringed instrument which has a plurality of strings 2 which extend along the length of a neck 3 of the instrument with the strings 2 positioned adjacent to the surface 5 of a fingerboard 4 attached to the neck 3. The fingerboard includes a number of fret bars which are disposed along the neck, extend laterally across the neck, and protrude slightly from the surface 5 of the fingerboard 4. The capo 1 when installed is arranged to clamp the strings 2, and press the strings 2 towards the fingerboard 4 of the neck 3 with the strings 2 generally sandwiched between the capo 1 and the fingerboard surface 5 of the neck 3. Specifically the strings 2 are generally clamped against the fret bars of the fingerboard 4 by the capo 1.

The capo 1 comprises a generally T shaped string-engaging part 6. The part 6 includes a main string-engaging arm 7 which extends across the width of the fingerboard 4 and which when the capo 1 is fitted to the neck 3 engages with the strings 2 to press the strings 2 towards and against the fingerboard surface 5 of the neck 3, and in particular against the fret bars of the fingerboard 4. A resilient layer 8 may be provided on the lower surface of the string-engaging arm 7 which contacts with the strings 2. A second arm 9 of the string-engaging part 6 extends generally perpendicular to the string-engaging arm 7 and extends along and adjacent to one side of the neck 3. The second arm 9 is curved around the neck 3 so as to bring the axis of a pivot pin 10 behind the fingerboard 4, and inboard of the edge of the neck 3. A third arm 16 of the string-engaging part 6 extends generally perpendicular to the string-engaging arm 7 of the part 6 in generally the opposite direction to the arm 9 housing a pivot pin 10.

A clamping part 11 is pivotally attached via the pivot pin 10 to the string-engaging part 6. The clamping part 11 is generally L shaped. The clamping part 11 has a first arm 12 which, when the capo 1 is fitted to the neck 3, extends across the back of the neck 3 and abuts and bears against a back surface 13 of the neck 3 generally opposite to the fingerboard surface 5. As shown a resilient layer of material 14, to prevent damage to the neck 3, is provided on the portion of the clamping arm 12 that is arranged to abut against the neck 3 of the instrument. A second arm 15 of the clamping part 11 is generally perpendicular to the first arm 12 and is arranged to extend along behind the third arm 16 of the string-engaging part 6. The pivot pin 10 which pivotally interconnects the string-engaging part 6 and clamping part 11 is located towards one end of the arm 9 of the string-engaging part 6 and on the arm 12 of the clamping part 11 towards the point where the two arms 15 and 12 meet and at a position which when the capo 1 is fitted to the instrument, is generally adjacent to and towards one side of the neck 3 behind the fingerboard 4. In use the parts 6,11 are pivoted about the pin 10 so that the neck 3 of the instrument is clamped between the string-engaging arm 7 and the clamping arm 12 with the string-engaging arm 7 pressing the strings 2 towards the fingerboard surface 5, and specifically against the fret bars of the fingerboard 4, whilst the clamping arm 12 abuts and presses against the back, opposite, surface 13 of the neck 3. In this embodiment the clamping arm 12 abuts against the back, opposite, surface 13 of the neck 3 centrally on the centre line 23 of the neck 3. The clamping arm 12 may though abut against the back, opposite, surface 13 of the neck 3 slightly off and away from the centre line 23 of the neck, and indeed it may be preferably for the clamping arm 12 to abut slightly, beyond (as measured from the pivot) the centerline 23 and directed slightly back towards the second arm 9 in order to urge the neck into the capo 1.

A spring 17 is provided to urge the arms 16,15 apart and thus urge the string-engaging arm 7 and the clamping arm 12 towards each other. The third arm 16 of the string-engaging part 6 and the second arm 15 of the clamping arm 11 comprise lever arms which can be gripped by a user and squeezed together to open the capo against the spring 17.

Preferably an inside edge portion of the second arm 9 abuts against the edge of the neck 3 to stabilize and locate the capo on the neck. In particular the inside edge has a fiat planar extending surface which is adapted to abut against the edge of the neck to orientate the capo on the neck 3. This also assists in applying the capo since it can be more positively located on the neck 3 by such an abutment of the second arm 9 against the neck, and assists in ensuring that the capo is correctly located on the neck, both perpendicular to the strings 2 and extending over the complete width of the neck.

Referring to FIG. 2, the force F exerted by the clamping arm 12 onto the back of the neck 3 is such as is required to press the string-engaging arm 7 against the strings 2 and the strings 2 towards the fingerboard surface 5 such that the strings 2 make good contact with the fret bars such that the strings 2 sound clearly when plucked or strummed without buzzing. This force F is relatively fixed by the purpose of the capo. The force F is governed by the rate and compression of the spring 17 and the distance of the axis of the spring 17 to the axis of the pivot pin 10 L3 which are adjusted in the design to give the required force F.

It can be seen, by taking moments about the axis of the pivot pin 10, with the force F remaining constant and the spring rate and/or distance L3 of the spring axis from the pivot axis adjusted to achieve this, that the squeezing force S at a given distance L1 from the axis of the pivot pin 10 is reduced as the distance L2 between the axis of the pivot pin 10 and the point 18 where the clamping arm 12 abuts the back surface 13 of the neck 3 is reduced. Thus by positioning the pivot pin 10 axis behind the fingerboard 4 and close to the centre line of the neck 3, it is possible to substantially reduce the force S which must be applied by the user of the capo 1 to remove or adjust the position of the capo 1 when compared to other state of the art designs.

It will be appreciated that the exact positioning of the pivot axis behind the fingerboard is an important further aspect of the invention and determines the forces required to operate the capo and clamp the capo on the instrument. In particular the distance L5 of the pivot 10 from the centerline 23 of the fingerboard is preferably between 30% and 90% of the distance L4 from the centerline 23 of the fingerboard to the edge of the fingerboard. More specifically it is preferred that the pivot axis is located between 10% to 30% of the width of the fingerboard from one edge of the fingerboard.

Figure 3:
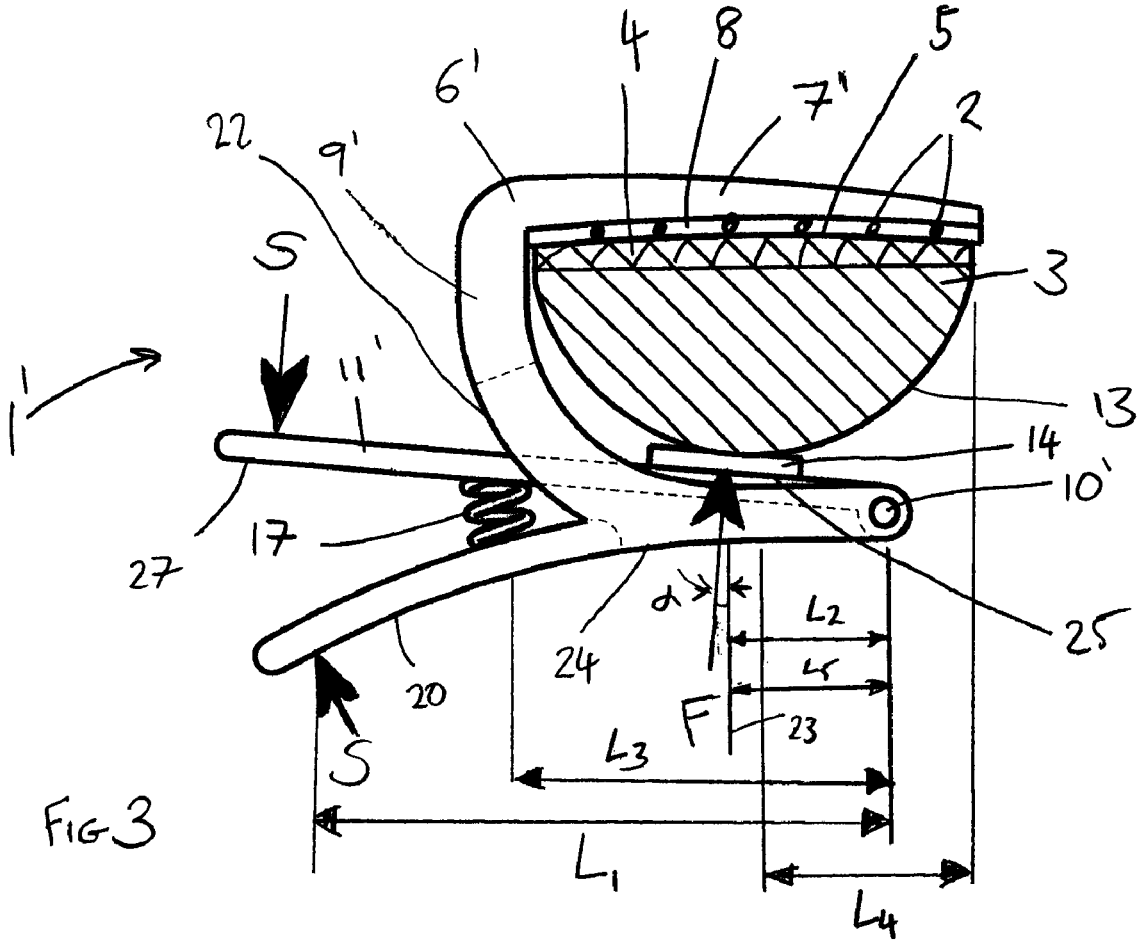
FIG. 3 is a cross section through the neck of a stringed instrument and side elevation of a capo according to a second embodiment of the present invention installed on the neck.
Figure 4:
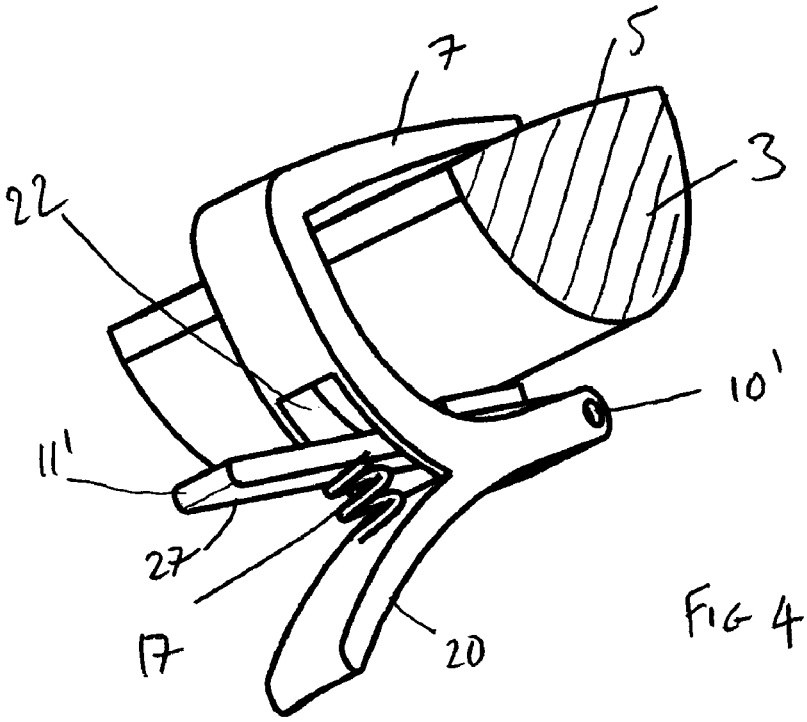
FIG. 4 is a perspective view of the capo shown in FIG. 3 installed on the neck of the stringed instrument.

FIGS. 3 and 4 show an alternate second embodiment of the invention. This is generally similar and like reference numerals have been used to refer to like parts. In this embodiment and capo 1' the main difference is that the pivot 10' axis is positioned further behind the neck, beyond the mid point and centerline 23 of the fingerboard, and the clamping arm 11' is reversely directed.

More specifically the capo 1' comprises a generally U shaped string-engaging part 6'. The string-engaging part 6' includes a main string-engaging arm 7' which extends across the width of the fingerboard 4 and which when the capo 1' is fitted to the neck 3 engages with the strings 2 to press the strings 2 towards and against the fingerboard surface 5 of the neck 3, and in particular against the fret bars of the fingerboard 4. A resilient layer 8 may be provided on the lower surface of the string-engaging arm 7' which contacts with the strings 2. A second arm 9' of the string-engaging part 6' extends generally perpendicular to the string-engaging arm 7' and extends along and adjacent to one side of the neck 3. The second base arm 9' is curved around the neck 3, and extends into a third arm 24 which extends behind and along the back surface 13 of the neck 3 generally parallel to the string-engaging arm 7'. A pivot pin 10' is mounted at the distal end of the third arm 24 behind the fingerboard 4, beyond the centerline 23 of the fingerboard and neck 3 but inboard of the near edge of the neck 3, and yet also inboard of the far edge of the neck 3. The string-engaging part 6' also further includes an extension arm 20 extending from the second base portion arm 9' at the juncture of the base portion arm 9' and third arm 25 generally parallel to the string-engaging arm 7' and third arms 24 but in the opposite direction to the third arm 24. As such the string-engaging part 6' in this embodiment is generally h shaped adapted such that the neck 3 locatable within the arch of the h.

A clamping part 11' is pivotally attached at one end via the pivot pin 10' to the third arm 24 of the string-engaging part 6. The clamping part 11' in this case is generally straight. The clamping part 11' has a first portion 25 which, when the capo 1' is fitted to the neck 3, extends across the back of the neck 3 and abuts and bears against a back surface 13 of the neck 3 generally opposite to the fingerboard surface 5. As shown a resilient layer of material 14, to prevent damage to the neck 3, may be provided on the first portion 25' of the clamping arm 11' that is arranged to abut against the neck 3 of the instrument. The clamping part 11' extends through an aperture 22 in the string-engaging part 6' and specifically through the second base arm 9', and beyond the second base arm 9'. A distal end portion 27 of the clamping arm 11' lies adjacent and along the extension arm 20 of the string-engaging part 6'.

In use the parts 6', 11' are pivoted about the pin 10' so that the neck 3 of the instrument is clamped between the string-engaging arm 7' and the first portion 25 of the clamping arm 11' with the string-engaging arm 7' pressing the strings 2 towards the fingerboard surface 5, and specifically against the fret bars of the fingerboard 4, whilst the first portion of the clamping arm 11' abuts and presses against the back, opposite, surface 13 of the neck 3.

In this embodiment the clamping arm 11' abuts against the back, opposite, surface 13 of the neck 3 just of the centre line 23 of the neck 3, and at an angle to a normal to the fingerboard 5 such that the force F applied is at an angle $\alpha$ to the centerline 23. The first portion 25 of the clamping arm 11' may though alternatively abut on the centerline or on the other side of the centre line 23 in other embodiments.

A spring 17 is located between the extension arm 20 and the distal end portion 27 of the clamping arm 11' to urge the arms 11', 20 apart and thus urge the string-engaging arm 7' and the first portion 25 of the clamping arm 11' towards each other. The extension arm 20 of the string-engaging part 6 and the distal end portion 27 of the clamping arm 11' comprise lever arms which can be griped by a user and squeezed together to open the capo against the spring 17.

As in the previous embodiment this arrangement by positioning the pivot pin 10' axis behind the fingerboard 4 and it is possible to substantially reduce the force S which must be applied by the user of the capo 1' to remove or adjust the position of the capo '1 when compared to other state of the art designs. The exact positioning of the pivot axis behind the fingerboard furthermore being important and determining the forces required to operate the capo and clamp the capo on the instrument. In this embodiment too, as in the previous embodiment, the distance L5 of the pivot 10' from the centerline 23 of the fingerboard is preferably between 30% and 90% of the distance L4 from the centerline 23 of the fingerboard to the edge of the fingerboard. More specifically it is preferred that the pivot axis is preferably located between 10% to 30% of the width of the fingerboard from one edge of the fingerboard. In this case though the pivot axis is mounted towards the far side of the neck and beyond the centerline 23.

Preferably an inside edge portion of the second base arm 9' abuts against the edge of the neck 3 to stabilize and locate the capo on the neck 3.

The principle and mode of operation of this invention have been explained and illustrated in its preferred embodiment. However, it must be understood that this invention may be practiced otherwise than as specifically explained and illustrated without departing from its scope. In particular various modifications to the specific embodiments described above can of course be made. For example different types of springs may be used, for example torsion springs, and the springs may be located differently whilst still providing the required spring force to the arms 12, 7.

What is claimed is:

1. A capo for use with a stringed instrument having a plurality of strings and a neck comprising a fingerboard and a back, the capo comprising:

a string-engaging part having a string-engaging arm adapted to in use extend across the fingerboard above the strings and in use press against the strings;

a clamping part having a clamping arm adapted to, in use, extend across and engage the back of the neck;

a pivotal connection to pivotally interconnect the string-engaging part and clamping part; and a spring which is adapted to urge the string-engaging arm and clamping arm together;

wherein the pivotal connection is disposed, in use, generally towards one side of the neck and at a position behind the fingerboard inboard of a side edge of the fingerboard.

2. The capo of claim 1 wherein the pivotal connection is located at a position between a centerline of the neck and the side edge of the fingerboard of the neck.

3. The capo of claim 2 wherein the pivotal connection is located at a position from the centerline of the neck between 30 to 90% of the distance between the centerline of the neck and the side edge of the fingerboard of the neck.

4. The capo of claim 1 wherein the clamping arm is adapted in use to engage the back of the neck substantially on a centerline of the neck.

5. The capo of claim 1 wherein the clamping arm is adapted in use to engage the back of the neck to one side of a centerline of the neck.

6. The capo of claim 1 wherein the string-engaging part has a portion which is adapted to in use extend along a side edge of the fingerboard and neck, and around at least a part of the back of the neck.

7. The capo of claim 6 wherein said portion of the string-engaging part extends from the side edge of the fingerboard and neck, and around at least a part of the back of the neck beyond a centerline of the neck.

8. The capo of claim 1 wherein the pivotal connection pivotally interconnects the clamping part to the string-engaging part at a point part way along the clamping part.

9. The capo of claim 1 wherein the pivotal connection pivotally interconnects the clamping part to the string-engaging part at an end of the clamping arm.

10. The capo of claim 1 wherein the clamping part extends though an aperture defined in the string-engaging part.

11. The capo of claim 1 wherein the spring is disposed between the string-engaging part and the clamping part, to urge the arms together.

12. The capo of claim 1 wherein the string-engaging part and the clamping part further comprise lever arms attached to each of the clamping and string-engaging parts for opening and moving the string-engaging and clamping arms with respect to each other.

13. The capo of claim 12 wherein the lever arms lie and extend adjacently to each other.

14. The capo of claim 12 wherein an end portion of the clamping arm forms the lever arm of the clamping part.

15. The capo of claim 12 wherein the lever arm of the string-engaging part comprises an extending arm portion projecting from the remainder of the string-engaging part.

16. The capo of claim 1 wherein the string-engaging part and the clamping part comprise lever arms for opening and moving the string-engaging and clamping arms with respect to each other, and wherein the pivotal connection is located at a position from a centerline of the neck between 30% to 90% of the distance between the centerline of the neck and the side edge of the fingerboard of the neck.

17. A capo for use with a stringed instrument having a plurality of strings and a neck comprising a fingerboard and a back, the fingerboard having first and second side edges that extend along a length of the neck, the capo comprising:

a string-engaging part having a string-engaging arm adapted to in use extend across the fingerboard above the strings and in use press against the strings;

a clamping part having a clamping arm adapted to, in use, extend across and engage the back of the neck;

a pivotal connection that pivotally interconnects the string-engaging part and the clamping part, the pivotal connection defining a pivot axis about which the clamping part is pivotable relative to the string-engaging part; and a spring that urges the string-engaging arm and clamping arm together;

wherein the pivot axis is disposed, in use, at a position behind the fingerboard between the side edges of the fingerboard.

18. The capo of claim 17 wherein, in use, the pivot axis is spaced away from a centerline of the neck at a first distance that is between 30% and 90% of a second distance from the centerline to one of the side edges of the fingerboard, and wherein the spring is disposed between the string-engaging part and the clamping part to urge the arms together.

19. The capo of claim 17 wherein, in use, the pivot axis is spaced away from one of the side edges of the fingerboard by a distance that is between 10% and 30% of a width of the fingerboard.

20. The capo of claim 17 wherein the clamping part is generally straight, and wherein the pivotal connection pivotally interconnects the clamping part to the string-engaging part at an end of the clamping part.

* * * * *